US005109737A

United States Patent [19]

Raber

[11] Patent Number: 5,109,737

[45] Date of Patent: May 5, 1992

[54] EXTENDED TOOL

[76] Inventor: Scott M. Raber, 426 Old Bridge Rd., Northport, N.Y. 11768

[21] Appl. No.: 716,209

[22] Filed: Jun. 17, 1991

[51] Int. Cl.[5] ..... B25B 23/16

[52] U.S. Cl. ..... 81/177.2; 81/177.1

[58] Field of Search ..... 81/177.2, 177.1, 177.8, 81/177.9, 177.88

[56] References Cited

U.S. PATENT DOCUMENTS

| | | | |
|---|---|---|---|
| 2,382,291 | 8/1945 | Carlberg . | |
| 2,963,930 | 12/1960 | Clothier et al. . | |
| 3,306,639 | 2/1967 | Lyon . | |
| 4,070,932 | 1/1978 | Jeannette . | |
| 4,367,663 | 1/1983 | Merics | 81/177.2 |
| 4,376,397 | 3/1983 | Newby et al. | 81/177.2 |
| 4,409,866 | 10/1983 | McBride . | |
| 4,440,517 | 4/1964 | Potter et al. . | |
| 4,581,958 | 4/1986 | Shull | 81/177.2 |
| 4,586,406 | 5/1986 | Howard . | |

*Primary Examiner*—Bruce M. Kisliuk
*Assistant Examiner*—Lawrence Cruz
*Attorney, Agent, or Firm*—Galgano & Belkin

[57] ABSTRACT

A ratchet wrench with a sleeve on its handle which is rotatable and slidable. The handle is hollow with a spring or spring steel loaded detent extending out through a hole adjacent to the free end of the handle with a threaded cover providing easy access to replace the detent and/or its spring. The sleeve is provided with a plurality of holes to receive the detent for positioning the sleeve. By extending the sleeve, the tool can be employed to increase the amount of torque or leverage to be applied as desired.

7 Claims, 2 Drawing Sheets

EXTENDED TOOL

BACKGROUND OF THE INVENTION

This invention relates to a hand tool and more particularly to a hand tool which is extensible for obtaining improved leverage.

Some hand tools, such as ratchet wrenches, have extended arms to provide leverage in loosening or tightening nuts or other members. In some cases, the presence of corrosion requires a very high torque to loosen or tighten the member It is possible to extend the arm length of the tool sufficient to obtain any maximum torque which could conceivably be required, but this makes the tool unwieldy large and bulky for every day use when the additional torque is not required.

A number of United States Patents have been issued for tools which have extensible arms. The following are examples of such patents.

U.S. Pat. No. 2,382,291 shows an extensible hand tool relying on a split ring as a holding member.

U.S. Pat. No. 2,963,930 discloses an extensible torque bar which relies on a ball mounted in a sleeve which slides.

U.S. Pat. No. 3,306,639 describes an extensible torque rod which relies on a roller mounted in a sleeve and drops into slots on the rod.

U.S. Pat. No. 4,070,932 provides an extendible handle for a tool in which a spring mounted sleeve is locked in place by a set screw.

U.S. Pat. No. 4,440,517 discloses an adjustable torque-multiplier breaker bar which relies on a pair of balls to drop into slots in a sleeve.

U.S. Pat. No. 4,409,866 shows a tool handle with a trigger member with a leg to lock a handle in place.

U. S. Pat. No. 4,581,958 has an extensible handle assembly relying on a ball falling into a groove to set the handle length and provision to lock the extensible member on the handle.

U.S. Pat. No. 4,586,406 discloses an extendible wrench relying on detent pins to hold the extendible member in place.

The arrangements appearing in the preceding patents are complex and costly to make, and, in addition, they do not appear to be designed for ease of separation of the extensible portion or repair None of these patents teaches the present invention.

SUMMARY OF THE INVENTION

This invention comprises a tool having an extendible arm member for improved torque when required, and which may conveniently be removed if desired so that the tool need not be bulky, excessively heavy, or unwieldy in normal use.

A preferred embodiment of this invention consists of a ratchet wrench having mounted adjacent the tip of the handle a spring mounted detent. The tip of the handle has a threaded opening to provide access to the detent and its spring and a screw member to close the opening, thus rendering it convenient and easy to remove or replace the detent and/or its spring. A sleeve with openings to accomodate the detent is slipped over the handle when additional torque is required, thus the sleeve is normally stowed for those occasions when it is actually required.

It is thus a principal object of this invention to provide an extensible tool which is convenient to use while at the same time is economical in construction and easy to maintain, repair and to operate.

Other objects and advantages of this invention will hereinafter be obvious from the following description of preferred embodiments of this invention.

DESCRIPTION OF THE PREFERRED EMBODIMENTS

Figure 1:
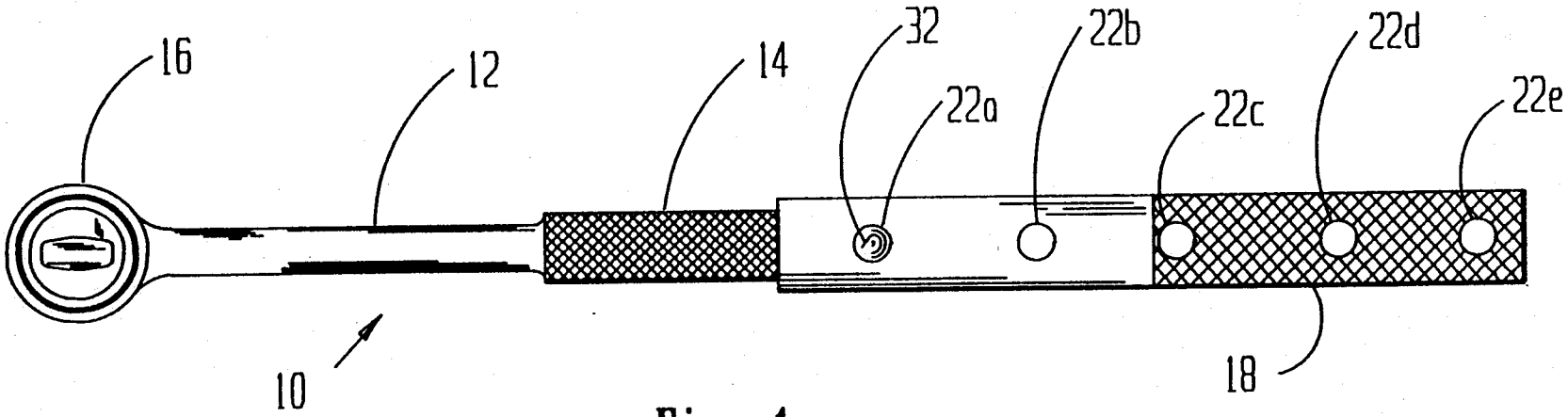
FIG. 1 is an elevation view of a ratchet wrench incorporating the principles of this invention adjusted for maximum torque.

Referring to FIG. 1, ratchet wrench 10 embodying the principles of this invention comprises a shank 12 with a knurled cylindrical handle 14 at one end and a tool-engaging assembly 16 at the other end which, as is understood in the art, could consist of a ratchet lug as illustrated.

Figure 5:
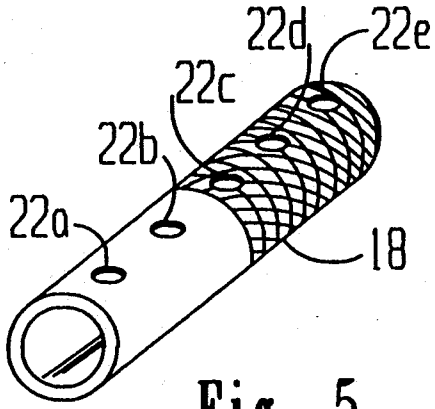
FIG. 5 is an isometric view of the sleeve.

Fitted over handle 14 is a slidable and rotatable cylindrical sleeve member 18, seen also in FIG. 5, with a plurality of holes **22*a*, 22*b*, 22*c*, 22*d*, and 22*e*** in a line as illustrated.

Figure 2:
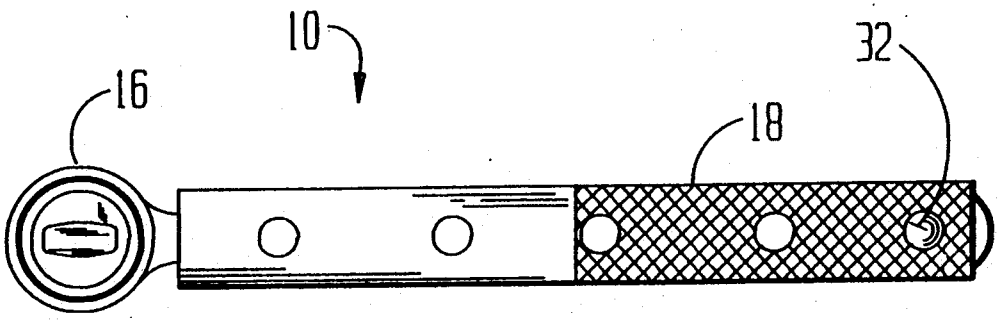
FIG. 2 is a view similar to FIG. 1 with the handle adjusted for minimum torque or storage.

When sleeve member 18 is extended to its furthest outward position which extends to almost twice the length of the original sized tool handle 14 as shown in FIG. 1 then maximum torque can be applied to tool-engaging assembly 16 which may be engaging a nut, for example, but not shown. When sleeve member 18 is retracted to its most contracted position as shown in FIG. 2, no additional torque is added to wrench 10, in other words, it would be as if sleeve member 18 were not present. In this position of sleeve 18, if desired, wrench 10 may be stowed, taking up little, if any, additional space in a tool box or drawer.

As will be seen from the following description, sleeve member 18 may be adjusted to any number of intermediate positions, providing additional torque capability as required, and yet capable of adjusting to many space limitations which might apply at the time of use, not only because a certain torque or leverage may be desired but the user may be in a predicament where he is forced to use one of the middle notches for torque or leverage due to the fact that certain components will be in the way and the full extension of the handle will not be possible.

Figure 4:
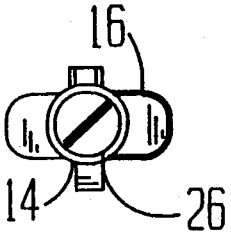
FIG. 4 is a right end view of the wrench shown in FIG. 3.
Figure 3:
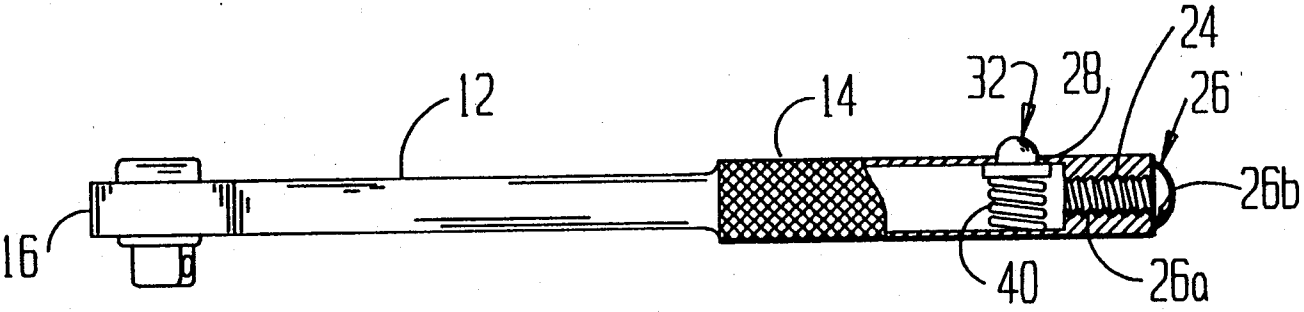
FIG. 3 is a side view of the wrench shown in FIG. 1 with the sleeve removed and partially cut away.

In order to lock sleeve member 18 in any preselected position along the length of handle member 14, as best seen in FIGS. 3 and 4, showing wrench 10 without sleeve member 18, handle 14 is circular in cross section and hollow with a threaded opening 24 at its free end to accomodate a screw 26. Screw 26 comprises a male threaded barrel **26*a* and a slotted head 26*b***. It is understood that instead of a slotted head, there may be instead a hex head or a phillips head as is understood in the art.

Figure 6:
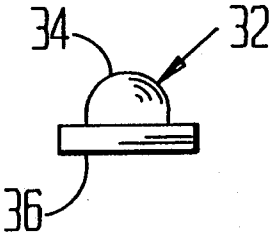
FIG. 6 is an elevation view of the detent.

In the side wall of handle 14 adjacent the threads lining opening 24 is an opening 28 to accomodate a detent 32, also seen in FIG. 6, which is cylindrical in shape with a spherical surface 34 at one end and a shoulder 36 at the other end. A spring 40 under shoulder 38 as seen in FIG. 3 biases detent 32 outwardly, and can be compressed inwardly as is understood in the art.

Hence, referring to FIGS. 1 and 2, sleeve member 18 may be adjusted into any one of five fixed positions, depending on the number of holes, and detent 32 popped into the selected hole in sleeve member 18 will hold the latter in that position. To move sleeve member 18, detent 32 will be depressed using a finger, for example, and sleeve member 18 can be moved or rotated.

Sleeve member 18 can also be adjusted to any position between the holes in this member, and to facilitate its adjustment, member 18 can be rotated so that detent 32 is not aligned with the holes, to make it easier to adjust its position along the length of handle member 14 without detent 32 accidentally popping into a hole.

In the normal use of wrench 10, sleeve member 18 can either be removed and stored separately to reduce the weight of the tool, or can be moved into the position shown in FIG. 2 where sleeve member 18 will not interfere with the normal use of the tool.

Figure 8:
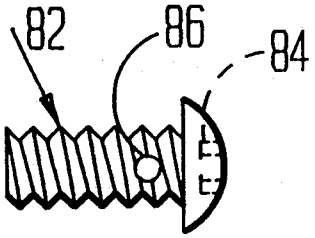
FIG. 8 is an elevation view of an alternative screw design.
Figure 7:
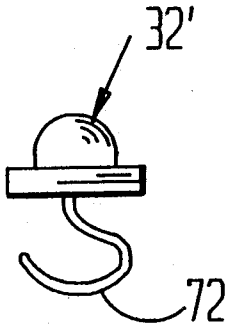
FIG. 7 is an elevation view of an alternative spring design.

Certain variations of this invention are possible. Instead of coil spring 40, for example, a spring comprising a spring steel member 72 as shown in FIG. 7 may be employed to bias detent 32. Instead of screw 26, a screw 82 as shown in FIG. 8 may be used. Screw 82 is provided with a hex hole 84 instead of a slot avoiding a sharp edge on the tool, and a hole 86 in the side may be provided for a loctite plastic insert as is understood to prevent loosening of the screw over a period of time as the tool is being employed.

The invention has been described in connection with its use on a ratchet wrench, but it is understood it could be useful on a number of tools such as a pipe wrench, an adjustable crescent wrench, bottle jack handles, etc., wherever it would be handier to have adjustable increased torque. In addition, a single sleeve 18 can be used on a number of different tools having handles which are sized and shaped to receive it.

A tool incorporating this invention not only provides the mechanic with more leverage in loosening a fastener or more torque for tightening, but also highly reduces the chances of knuckle injury with which any mechanic is familiar.

Important advantages of the tool herein described are its simple and economic construction, its ease of use, and a construction which lends itself to the convenient replacement of detent 32 and/or its spring 40. The latter feature is very important because tools of this type tend to be roughly used, i.e., by dropping or tossing, for example, and high quality tools can be very expensive. Thus, being able to disassemble the tool for cleaning or to replace a defective detent or spring simply and inexpensively rather than purchasing a new tool is an important aspect of this invention.

While only a preferred embodiment of this invention has been described, it is understood that many variations of this invention are possible without departing from the principles of this invention as defined in the claims which follow.

What is claimed is:

1. A wrench comprising a shank, an extended handle means attached at one end to said shank to provide leverage, tool engaging means projected at right angles to the length of said handle means also attached to said shank, the improvement in which said extended handle means comprises a hollow cylinder of circular cross section open at the other end of said handle means, the open end of said cylinder having internal threads, a threaded male member for engagement with said internal threads for closing said open end, a hole in said cylinder adjacent the open end thereof, detent means within said cylinder extending out through said hole, a spring within said cylinder for biasing said detent means outwardly, said detent means and said spring being readily installed and replaced through said open end when said threaded male member is removed, an extended sleeve member of cylindrical shape and circular in cross section for sliding over and enclosing said handle means and being removable by merely sliding out from said handle means, said sleeve member being both slidable along the length of said handle means to increase or decrease leverage applied to said tool engaging means and rotatable on said handle means to permit said sleeve member to be positioned continuously variable both along the length of said handle means and rotationally as well, a plurality of spaced holes in said sleeve member aligned in a row, each of said holes being sufficiently large to accomodate said detent means to lock said sleeve member in any one of several fixed positions as determined by the hole in which said detent means penetrates, said detent means being pressed inwardly out of the aforesaid hole to permit said sleeve to be moved, said sleeve member thereby being adjustable between fixed positions without stopping at intermediate fixed positions by rotating said sleeve member.

2. The tool as described in claim 1 in which said detent means comprises a solid cylinder with a leading edge semi-spherical in shape to enter one of the holes in said sleeve and having a shoulder at the other end thereof in contact with said spring.

3. The tool as described in claim 2 in which both said handle means and said sleeve are knurled on the outside.

4. The tool as described in claim 3 in which said spring comprises a spring steel member.

5. The tool as described in claim 3 in which said threaded male member comprises a male threaded member and a head provided with a hex hole in said head for being driven and a hole running transversely through said male member for filling with a plastic material to resist loosening of said male member while said tool is in service.

6. The tool as described in claim 3 wherein said threaded male member is provided with a phillips head.

7. The tool as described in claim 3 wherein said threaded male member is provided with a slotted head.

* * * * *